US009111702B2

(12) United States Patent
Chen et al.

(10) Patent No.: US 9,111,702 B2
(45) Date of Patent: Aug. 18, 2015

(54) KNOB STRUCTURE AND ELECTRONIC DEVICE THEREOF

(71) Applicant: Wistron Corporation, New Taipei (TW)

(72) Inventors: Jhih-Ming Chen, New Taipei (TW); Wen-Jui Lin, New Taipei (TW); Chia-Ching Lee, New Taipei (TW)

(73) Assignee: Wistron Corporation, New Taipei (TW)

( * ) Notice: Subject to any disclaimer, the term of this patent is extended or adjusted under 35 U.S.C. 154(b) by 212 days.

(21) Appl. No.: 13/842,160

(22) Filed: Mar. 15, 2013

(65) Prior Publication Data

US 2014/0027255 A1 Jan. 30, 2014

(30) Foreign Application Priority Data

Jul. 25, 2012 (TW) ..... 101126832 A

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/7065*** | (2006.01) |

(52) U.S. Cl.

CPC ..... *H01H 13/7065* (2013.01); *H01H 2219/064* (2013.01); *H01H 2221/044* (2013.01); *H01H 2229/046* (2013.01); *H01H 2233/004* (2013.01); *H01H 2239/008* (2013.01)

(58) Field of Classification Search

CPC ..... H01H 1/00; H01H 3/00; H01H 3/12; H01H 13/70; H01H 13/00; H01H 13/26; H01H 13/50; H01H 2003/12; H01H 2021/00; H01H 2013/00; H01H 2201/00; H01H 2205/00; H01H 2221/00; H01H 2221/016; H01H 2233/00; H01H 2233/002; H01H 2233/008; H01H 2233/05; H01H 2233/07; H01H 2233/09; H01H 2237/00; H01H 2237/004; H01H 3/02

USPC ..... 200/5 A

See application file for complete search history.

(56) References Cited

U.S. PATENT DOCUMENTS

| | | | | |
|---|---|---|---|---|
| 7,525,056 | B2 * | 4/2009 | Chiba et al. | 200/314 |
| 2007/0046644 | A1 | 3/2007 | Lin et al. | |

(Continued)

FOREIGN PATENT DOCUMENTS

| | | | |
|---|---|---|---|
| CN | 101661847 | A | 3/2010 |
| CN | 201608075 | U | 10/2010 |
| CN | 102280289 | A | 12/2011 |
| TW | 200709015 | | 3/2007 |
| TW | M363062 | | 8/2009 |

(Continued)

OTHER PUBLICATIONS

Office Action issued on Oct. 3. 2014 by the Taiwanese Patent Office in corresponding TW Patent Application No. 101126832, and the English langauge translation thereof.

*Primary Examiner* — Edwin A. Leon
*Assistant Examiner* — Anthony R. Jimenez
(74) *Attorney, Agent, or Firm* — Muncy, Geissler, Olds & Lowe, P.C.

(57) ABSTRACT

A knob structure and an electronic device thereof are disclosed. The knob structure is assembled with a case of the electronic device and includes a plurality of pressing portions, an elastic component, and a fixing component. At least one pressing portion has a pressing rib used for pressing a switch module. The elastic component includes a main body and a plurality of elastic ribs. The plurality of elastic rib is disposed on the main body to support the pressing portion. When the pressing portion is pressed along a supporting direction, the elastic rib is capable of providing an elastic force. The fixing component includes a first end and a second end, wherein the first end connects to at least one of the plurality of pressing portions and the second end is extended along a direction different from the supporting direction and fixed to the case.

22 Claims, 7 Drawing Sheets

(56) References Cited

U.S. PATENT DOCUMENTS

| | | | |
|---|---|---|---|
| 2010/0051434 | A1 | 3/2010 | Liu |
| 2012/0312672 | A1 | 12/2012 | Hsieh et al. |

FOREIGN PATENT DOCUMENTS

| | | | |
|---|---|---|---|
| TW | M386537 | U1 | 8/2010 |
| TW | M4322082 | U1 | 6/2012 |

* cited by examiner

KNOB STRUCTURE AND ELECTRONIC DEVICE THEREOF

BACKGROUND OF THE INVENTION

1. Field of the Invention

The present invention relates to a knob structure and an electronic device thereof; more particularly, to a knob structure that can reduce occupied space and an electronic device thereof.

2. Description of the Related Art

With continuous development in technology, most of the electronic devices nowadays are designed to be lightweight and compact. Take notebook computer as an example, the screen size of the notebook computer is to be kept the same, but on the other hand, the case size of the notebook computer is getting smaller. Thus, the space occupied by the knob structure disposed on the notebook computer also needs to become smaller.

Please refer to FIG. 1 hereby, which is a diagram illustrating the knob structure of the prior art disposed on an electronic device. In the prior art, an electronic device 90 includes a knob structure 91, a case 92 and a circuit board 93 with a switch module 931 thereon. And the knob structure 91 has a plurality of pressing portions 911 for user to press and an elastic component 912. The pressing portion 911 is usually made of plastic material, and one side of each pressing portion 911 connects to the elastic component 912. The elastic component 912 is a spider-foot shape, and one side of each pressing portion 911 extends to connect to one or two pins.

At the same time, just as shown in FIG. 1A, which is a sectional view of the A-A side of the knob structure of the prior art in FIG. 1.

The elastic component 912 can have a positioning hole 912*a* thereon, for corresponding to the positioning rib 921 of the case 92. After the positioning hole 921 is fit into the positioning rib 921, fix the knob structure 91 to the case 92 through heat fusion or other method, so that the knob structure 91 can be fixed at specific position. Furthermore, an appropriate length of the elastic component 912 can provide elasticity, to ensure it will not be too hard to press or too soft to have the pressing portion 911 sagged, and lower than the exterior surface of the case 92.

Nevertheless, just as shown in FIG. 1, the electronic device 90 of the prior art needs have enough space in Y-axis direction (because the X-axis direction is limited by a plurality of the pressing portions 911 which are adjacent to each other) for disposing the elastic component 912 thereon, to provide enough elasticity in Z-axis direction. As a result, the dimension of the case 92 of the electronic device 90 (especially the dimension in Y-axis direction) must be limited by the structure of the elastic component 912 and cannot be reduced.

Therefore, it is necessary to invent a new knob structure and an electronic device thereof, to solve the shortcomings of the prior art.

SUMMARY OF THE INVENTION

It is an object of the present invention to provide a knob structure, which has the effect of reducing occupied space.

It is another object of the present invention to provide an electronic device having the abovementioned knob structure.

In order to achieve the abovementioned objects, the knob structure of the present invention is applied in a case of an electronic device. The knob structure includes a plurality of pressing portions, an elastic component, and a fixing component. The plurality of pressing portions is adjacent and aligned side by side for a user to press, wherein the at least one pressing portion has a pressing rib below for pressing a corresponding switch module of the electronic device. The elastic component includes a main body and a plurality of elastic ribs. The plurality of elastic ribs is disposed on the main body, wherein the at least one pressing portion connects to at least one elastic rib below and is supported upwardly by the corresponding elastic rib. Thus, when the at least one pressing portion is pressed along a supporting direction, the corresponding elastic rib is capable of providing an elastic force for resilience. The at least one fixing component includes a first end and a second end, wherein the first end connects to at least one of the plurality of pressing portions, and the second end is extended along a direction different from the supporting direction to be fixed to the case.

The electronic device of the present invention includes a case, a circuit board, and a knob structure. The case has a through hole. The circuit board is disposed under the through hole of the case, wherein the circuit board has a plurality of switch modules thereon. The knob structure is disposed inside the through hole of the case, wherein the knob structure includes a plurality of pressing portions, an elastic component, and a fixing component. The plurality of pressing portions are adjacent and aligned side by side for user to press, wherein at least one pressing portion has a pressing rib below for pressing one of the switch module of the electronic device respectively. The elastic component includes a main body and a plurality of elastic ribs. The plurality of elastic ribs is disposed on the main body, wherein the at least one pressing portion connects to at least one elastic rib below and is supported by the corresponding elastic rib. Thus, when the at least one pressing portion is pressed along a supporting direction, the corresponding elastic rib is capable of providing an elastic force for resilience. The at least one fixing component includes a first end and a second end, wherein the first end connects to at least one of the plurality of pressing portions, and the second end is extended along a direction different from the supporting direction to be fixed to the case.

DETAILED DESCRIPTION OF THE PREFERRED EMBODIMENT

The abovementioned objects, characteristics, and advantages of the present invention will become more apparent from the following detailed descriptions of concrete embodiment when taken together with the accompanying drawings.

Figure 2A:
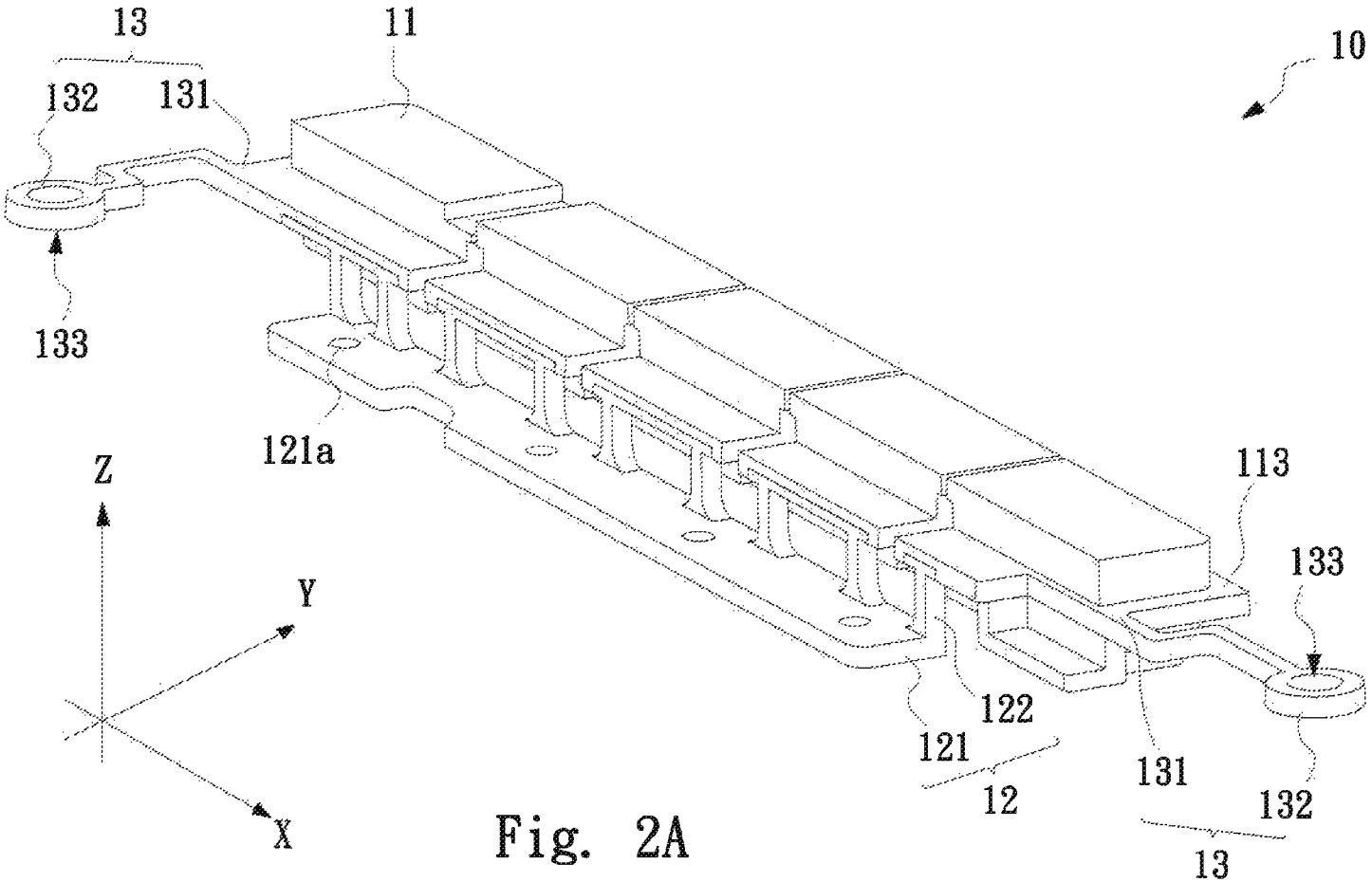
FIG. 2A is a stereogram illustrating the knob structure of the present invention.
Figure 2B:
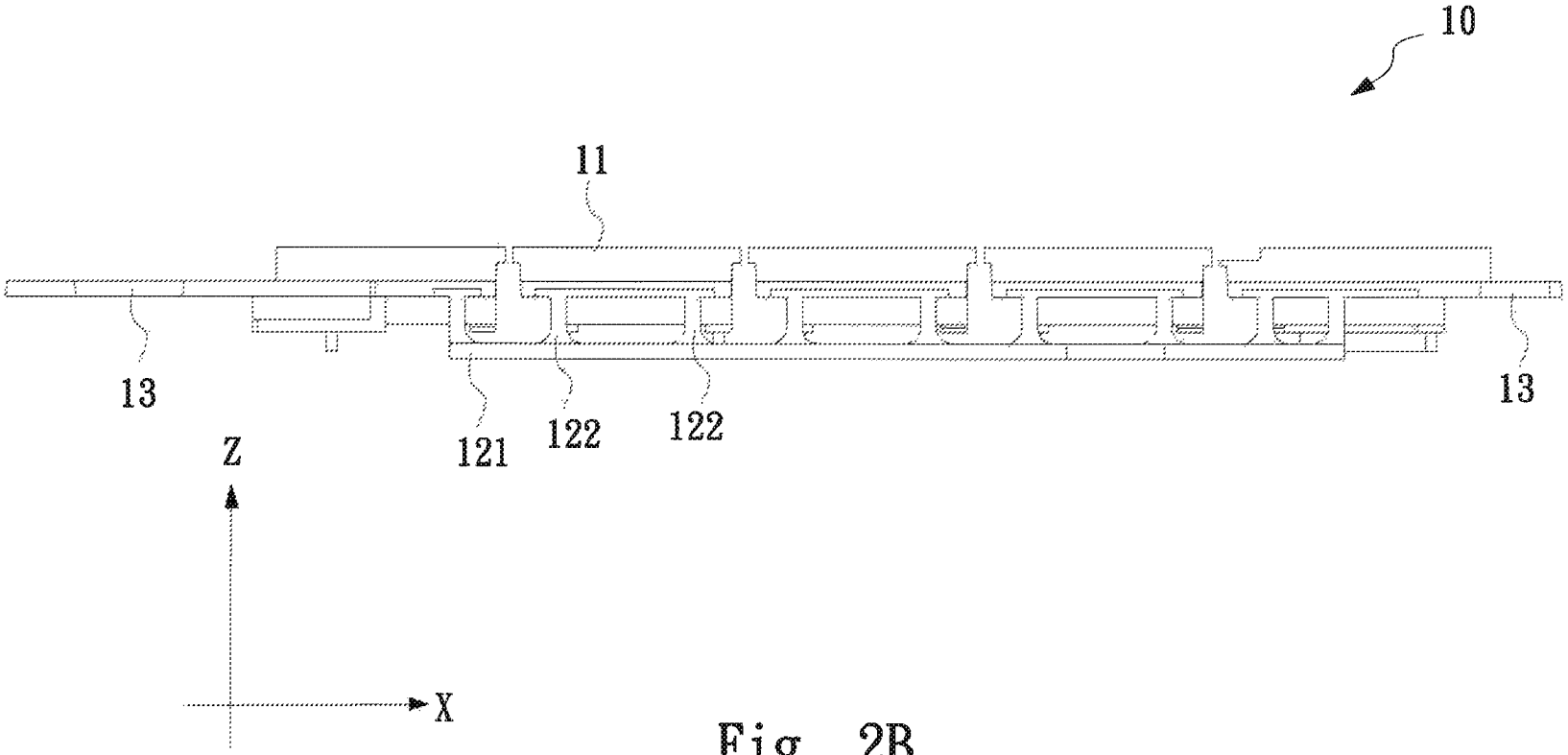
FIG. 2B is a lateral view illustrating the knob structure of the present invention.

Please refer to both FIG. 2A, which is a stereogram illustrating the knob structure of the present invention, and FIG. 2B, which is a lateral view illustrating the knob structure of the present invention.

Figure 4:
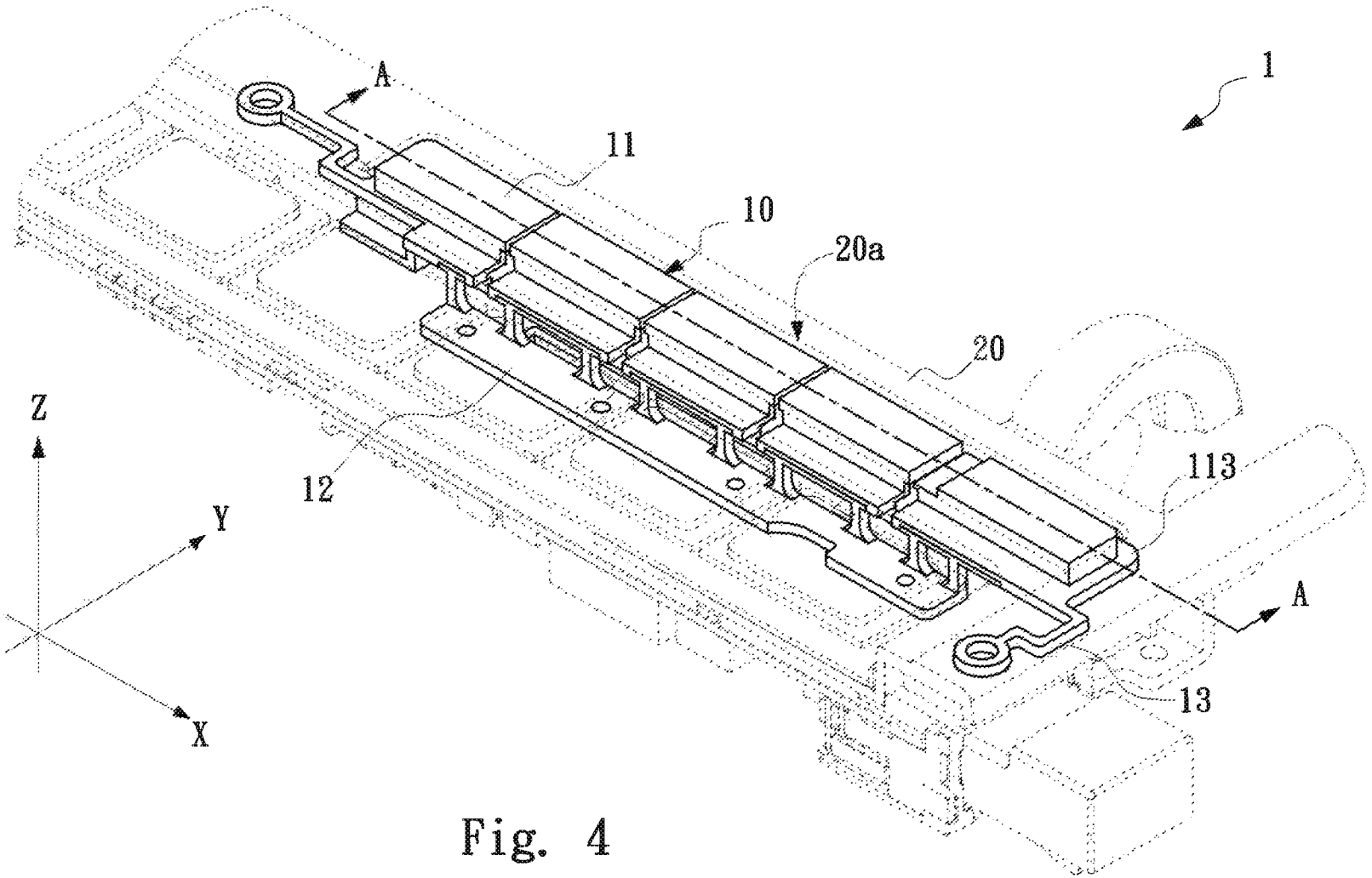
FIG. 4 is a diagram illustrating the electronic device with knob structure of the present invention.

The knob structure 10 of the present invention disposed on the electronic device 1 (as shown in FIG. 4) including a plurality of pressing portions 11, an elastic component 12, and a fixing component 13. Wherein the plurality of pressing portions 11 is made of hard plastic material, and the elastic component 12 is made of elastic rubber material that is softer than the aforementioned plastic material of the pressing portion 11, so that the knob structure 10 can be manufactured through a double-material injection processing, but the present invention is not confined to this aspect. The plurality of pressing portions 11 and the elastic component 12 both can also be made of rubber material with integrally formed or thermoformed.

The surface of the plurality of pressing portions 11 can be embossed a pattern or character (not shown in the FIG.) thereon by way of printing or etching to have user to recognize and press, and in one embodiment, the pattern or character is lucent. The plurality of pressing portions 11 in FIG. 2A is adjacent and aligned side by side along the X-axis direction and aligned to a strip-shape, but the present invention is not confined to this aspect. The elastic component 12 includes a main body 121 and a plurality of elastic ribs 122. Each of the elastic rib 122 is disposed on the main body 121, and at least one pressing portion 11 connects to at least one elastic rib 122 below in Z-axis direction and thus is supported upwardly by the corresponding elastic rib 122. Therefore, when the at least one pressing portion 11 is pressed along the supporting direction (e.g. Z-axis direction), the corresponding elastic rib 122 is capable of providing appropriate elastic force for resilience, so that the at least one pressing portion 11 can be back to the original position.

Figure 3:
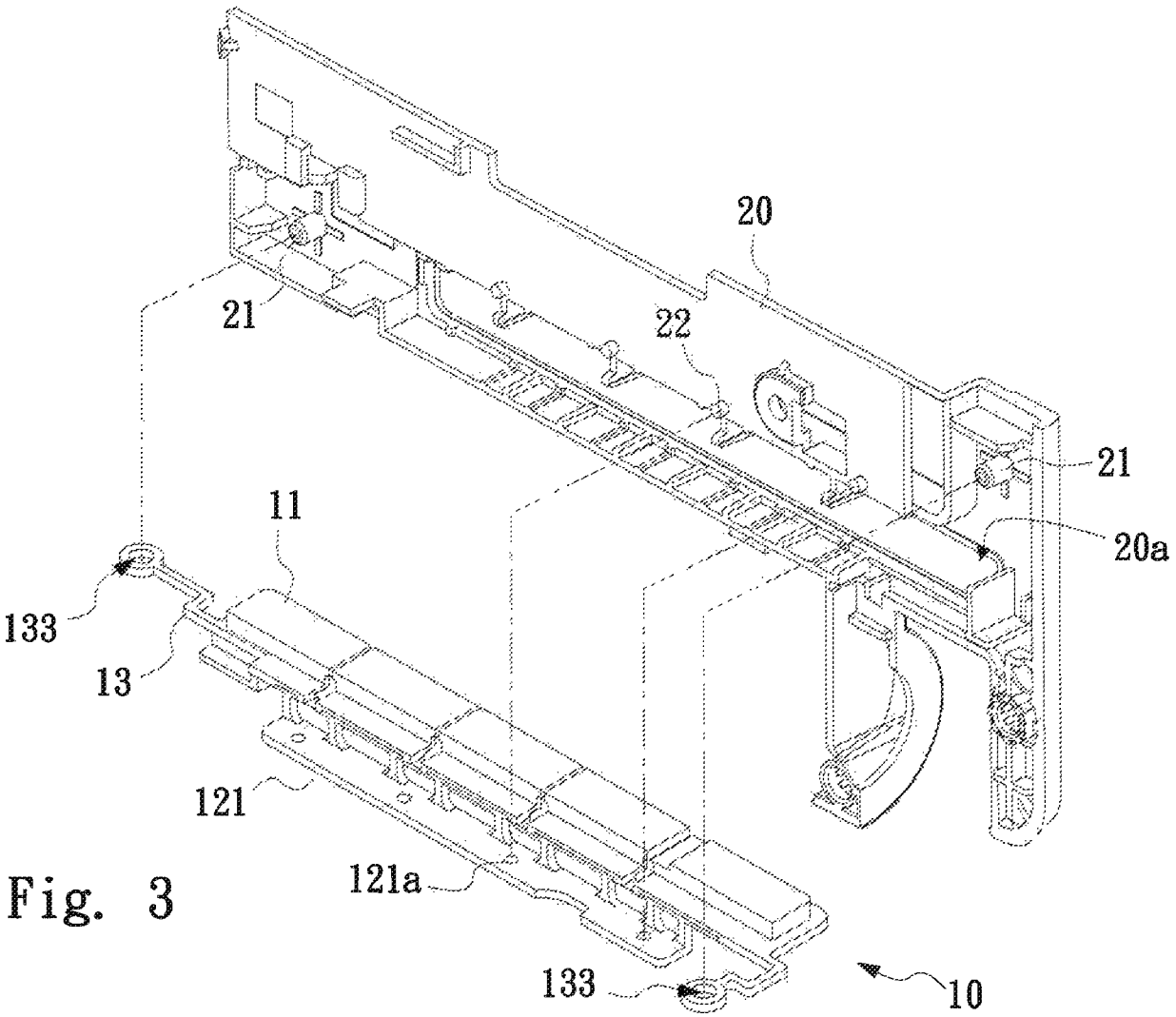
FIG. 3 is a diagram illustrating the assembly of the knob structure and the case of the present invention.

The fixing component 13 and the pressing component 11 can be made of same material with integrally formed, but the present invention is not confined to this aspect. The fixing component 13 has a first end 131 and a second end 132, wherein the first end 131 of the fixing component 13 connects to at least one of the plurality of pressing portions 11. Take FIG. 2A as an example, when the plurality of pressing portions 11 are aligned to a strip-shape, the two first end 131 of the fixing component 13 is connected to the at least one pressing portion 11 at the left-most side and the right-most side respectively. And the second end 132 of the fixing component 13 is extended along a direction different from the supporting direction (e.g. the X-Y plane horizontal direction), to connect fixedly to the case 20 (as shown in FIG. 3). As a result, the fixing component 13 can have the knob structure 10 fixed onto the case 20, and the fixing component 13 can also provide partial elastic force for resilience to the at least one pressing portion 11.

As regards the practical assembly method of the knob structure 10, please refer to FIG. 3 further, which is a diagram illustrating the assembly of the knob structure and the case of the present invention.

In the present embodiment, the fixing component 13 in coordination with the structure of the case 20 to form into a bar-curved shape to disposed on the inside of the case 20. The second end 132 of the fixing component 13 has a fixing hole 133, which is fit into the fixing rib 21 of the case 20 and then fixed onto the case 20 through heat fusion, so that it will not move because pressed by user. On the other hand, the main body 121 of the elastic component 12 can also has a plurality of position-limiting holes 121*a*, in coordination with the plurality of position-limiting ribs 22, to have the main body 121 to be positioned to the case 20. As a result, to make sure the knob structure 10 is assembled onto the correct position of the case 20.

Figure 4A:
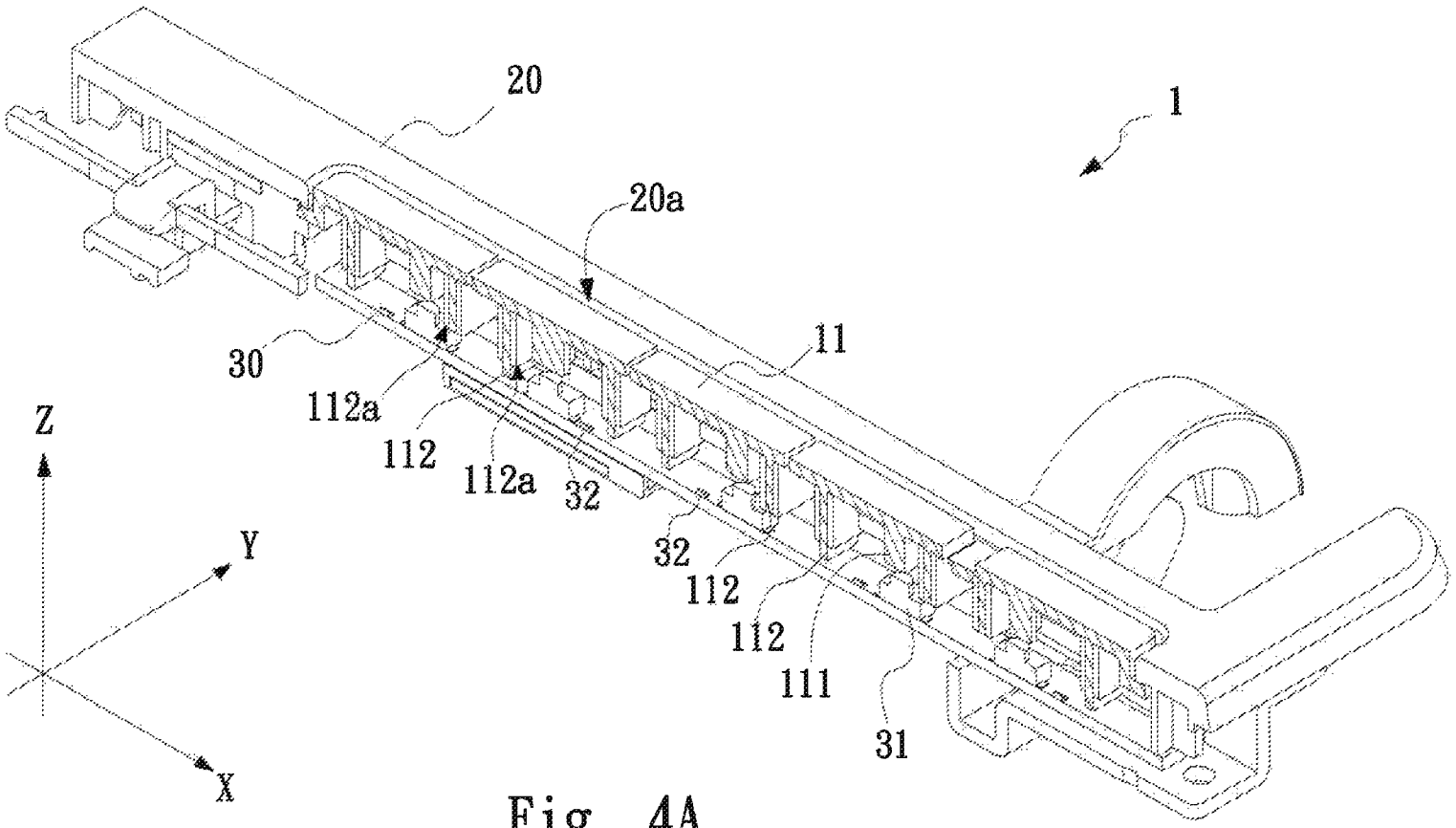
FIG. 4A is AA side sectional view illustrating the electronic device of the present invention in FIG. 4.

Finally, please refer to FIG. 4, which is a diagram illustrating the electronic device with knob structure of the present invention, and FIG. 4A is A-A side sectional view illustrating the electronic device of the present invention in FIG. 4.

The electronic device 1 of the present invention can be a notebook computer or other device with smaller volume, but the present invention is not confined to this aspect. In present embodiment, the electronic device 1 includes the aforementioned knob structure 10, the case 20 and the circuit board 30. The knob structure 10 is assembled and fixed to the case 20, and the surface of the pressing portion 11 of the knob structure 10 is exposed outside the through hole 20*a* of the case 20, to allow user to press. The circuit board 30 is disposed inside the case 20 and under the through hole 20*a*, wherein the circuit board 30 has a plurality switch modules 31 disposed thereon, which is positioned under the at least one pressing portion 11. The at least one pressing portion 11 has a corresponding pressing rib 111 below, so that when the at least one pressing portion 11 is pressed, the pressing rib 111 can press onto a corresponding switch module 31, to have the corresponding switch module 31 to generate trigger signal. The at least one pressing portion 11 can also have a retaining portion 112 below, wherein the retaining portion 112 keeps a distance with the pressing rib 111 and the length of the retaining portion 112 is greater than the pressing rib 111, to prevent the at least one pressing portion 11 from damaging the switch module 31 by pressing excessively. Furthermore, an extension structure 113 can be extended horizontally around the at least one pressing portion 11. The extension structure 113 can be extended to under the rim of the through hole 20*a* of the case 20, to provide electro-static discharge (ESD) protection.

On the other hand, the circuit board 30 can also have a light-emitting module 32 disposed right under the at least one pressing portion 11, wherein the light source emitted from the light-emitting module 32 can make the pattern or character disposed on the at least one pressing portion 11 light transparently, to indicate precise status of usage to the user. The light-emitting module 32 can be made of a light-emitting diode (LED), but the present invention is not confined to this aspect. And in order to prevent the user from being confused and mislead by the mutual scatter of the light sources from different light-emitting module 32 under the at least one pressing portion 11, the at least one pressing portion 11 can also have a shading structure disposed under. In present embodiment, the retaining portion 112 and the case 20 can surround into a rectangle as a shading structure, to shade the light-emitting module 32 so that the light emitted from the light-emitting module 32 will not scatter around. What should be noted is the present invention is not confined to the shading structure formed by the retaining portion 112 and the case 20. The retaining portion 112 can be used along or together with the elastic component 12 to form the shading structure. For example, when the material of the retaining portion 112 and the at least one pressing portion 11 is lucent plastic, in order to make sure the shading effect, both sides of the main body 121 of the elastic component 12 corresponding to the retaining portion 112 are formed with a shading portion, wherein at least partially of both sides of the retaining portion 112 are coated in the shading portion 112*a*. And the shading portion 112*a* can be made of rubber material, but the present invention is not confined to this aspect.

Figure 1:
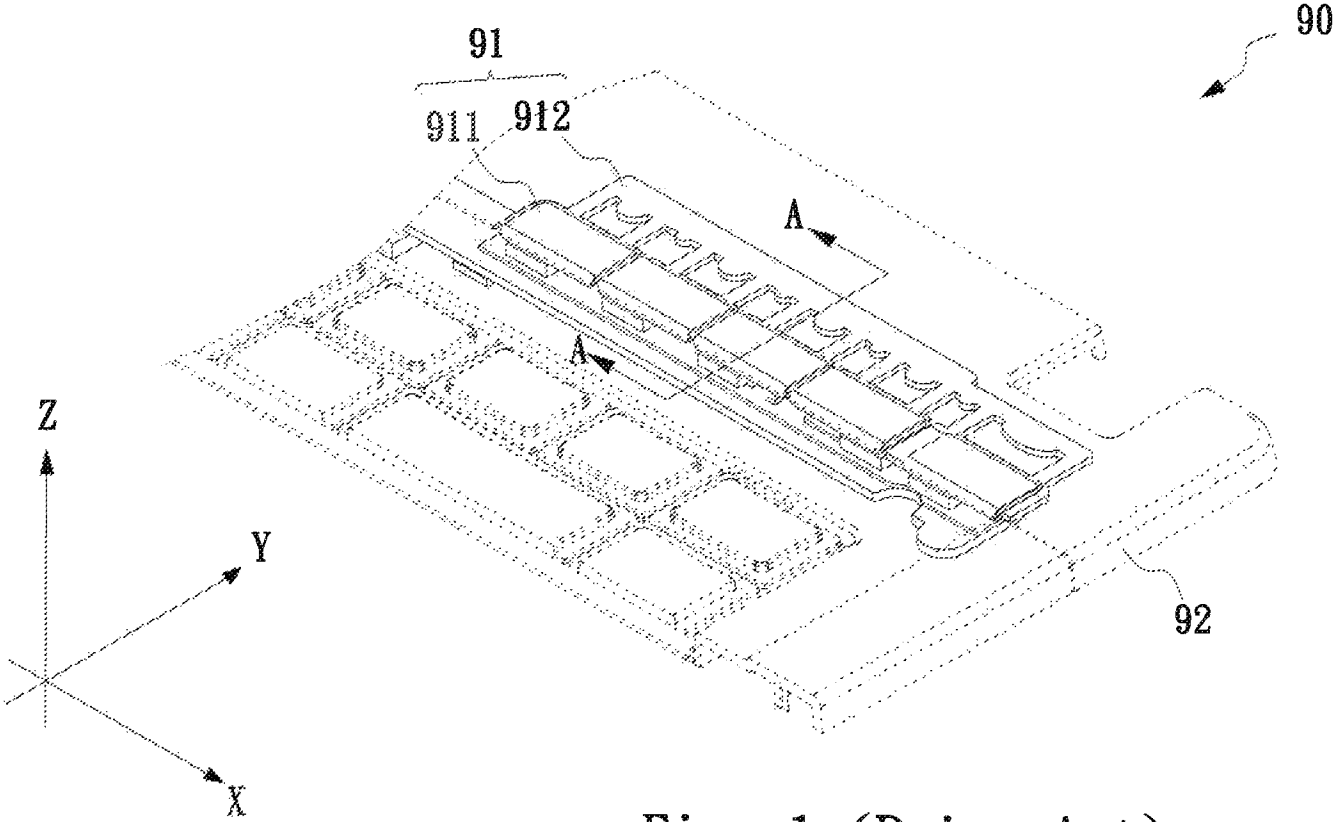
Fig. 1 (Prior Art)
FIG. 1 is a diagram illustrating the knob structure of the prior art disposed on an electronic device.
Figure 1A:
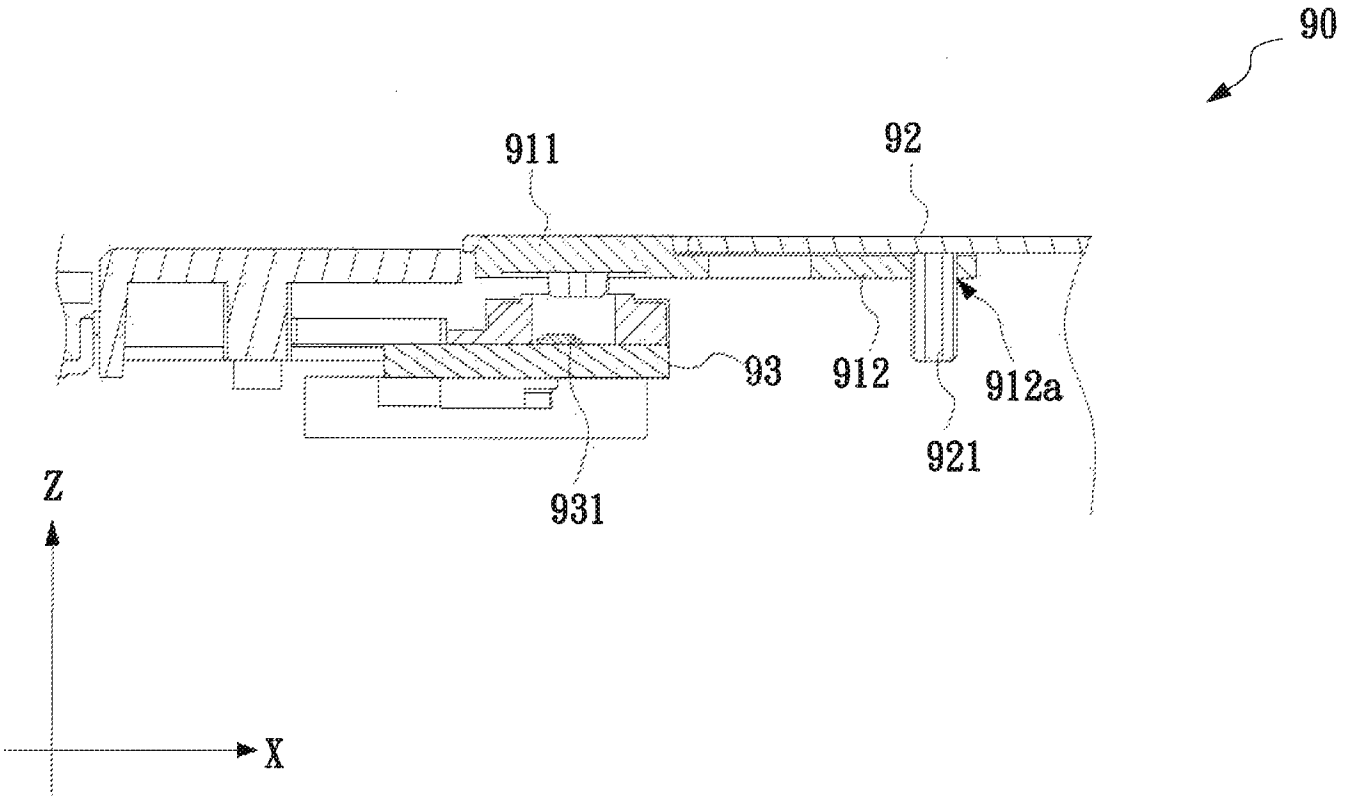
Fig. 1A (Prior Art)
FIG. 1A is AA side sectional view illustrating the knob structure of the prior art in FIG. 1.

Knowing from the abovementioned description, the knob structure 10 can have the at least one pressing portion 11 return to the original position through the elastic force for resilience provided by the corresponding elastic rib 122 along the supporting direction (e.g. Z-axis direction), and does not need to be as conventional structure to have the at least one pressing portion 11 extend along the Y-direction and disposed with spider foot. Therefore, it will not occupy the space of the case 20, at least at the Y-direction. Thus, when such knob structure 10 is disposed on the electronic device 1, like notebook computer, as shown in. FIG. 4, the width of the region in front of the keyboard that is close to the display screen of the case 20 can be reduced greatly (can compare with FIG. 1 of the previous mentioned prior art background) to have the dimension of the whole electronic device to be more lightweight and compact, and much easier for portable use.

To sum up, the present invention has greatly revealed the characteristics that are different from the prior arts no mater from the object, means, and function point of views. Earnestly request and deeply appreciate the examiner can be able to examine the tiniest things, and issue allowance at an early date in order to benefit the society What should be noted is, the abovementioned embodiments are provided for illustration only, and not for the purpose of limiting the scope of the invention as defined by the appended claims.

What is claimed is:

1. A knob structure applied in a case of an electronic device, the knob structure comprising:

a plurality of pressing portions adjacent and aligned side by side for a user to press, wherein at least one pressing portion has a pressing rib below for pressing a corresponding switch module of the electronic device respectively;

an elastic component comprising:

a main body; and a plurality of elastic ribs disposed on the main body, wherein the at least one pressing portion connects to at least one elastic rib below and is supported by the corresponding elastic rib, such that when the at least one pressing portion is pressed along a supporting direction, the corresponding elastic rib is capable of providing an elastic force for resilience; and at least one fixing component comprising a first end and a second end, wherein the first end connects to at least one of the plurality of pressing portions, and the second end is extended along a direction different from the supporting direction and fixed to the case.

2. The knob structure as claimed in claim 1, wherein the plurality of pressing portions and the elastic component are made of rubber material.

3. The knob structure as claimed in claim 1, wherein the plurality of pressing portions is made of plastic material, and the elastic component is made of rubber material.

4. The knob structure as claimed in claim I, wherein the at least one pressing portion has at least one retaining portion below, wherein the retaining portion keeps a distance with the pressing rib and the length of the retaining portion is greater than the pressing rib,

5. The knob structure as claimed in claim 1, wherein the at least one pressing portion extends an extension structure horizontally respectively.

6. The knob structure as claimed in claim 1, wherein the second end of the fixing component has a fixing hole, the case has a fixing rib, wherein the fixing hole and the fixing rib are fit to each other, to fix the knob structure to the case.

7. The knob structure as claimed in claim 1, wherein the main body of the elastic component has at least one position-limiting hole, and the case has at least one position-limiting rib, wherein the position-limiting hole and the position-limiting rib are fit to each other, to have the knob structure to be positioned on the case.

8. The knob structure as claimed in claim 1, wherein the first end of at least one fixing component is connected with the outmost one of the aligned plurality of pressing portions.

9. The knob structure as claimed in claim 1, wherein a surface of the at least one pressing portion has a lucent pattern or character.

10. The knob structure as claimed in claim 1, wherein the at least one pressing portion has a shading structure under.

11. An electronic device, comprising:

a case, with a through hole;

a circuit board disposed under the through hole of the case, wherein the circuit board has a plurality of switch modules; and a knob structure disposed inside the through hole of the case, wherein the knob structure comprises:

a plurality of pressing portions adjacent and aligned side by side for user to press, wherein at least one pressing portion has a pressing rib below respectively for pressing one of the switch module of the electronic device respectively;

an elastic component comprising:

a main body; and a plurality of elastic ribs disposed on the main body, wherein the at least one pressing portion connects to at least one elastic rib below and is supported by the corresponding elastic rib, such that when the at least one pressing portion is pressed along a supporting direction, the corresponding elastic rib is capable of providing an elastic force for resilience; and at least one fixing component comprising a first end and a second end, wherein the first end connects to at least one of the plurality of pressing portions, and the second end is extended along a direction different from the supporting direction and fixed to the case.

12. The electronic device as claimed in claim 11, wherein the plurality of pressing portions and the elastic component are made of rubber material.

13. The electronic device as claimed in claim 11, wherein the plurality of pressing portions is made of plastic material, and the elastic component is made of rubber material.

14. The electronic device as claimed in claim 11, wherein the at least one pressing portion has at least one retaining portion below, wherein the retaining portion keeps a distance with the pressing rib and the length of the retaining portion is greater than the pressing rib.

15. The electronic device as claimed in claim 14, wherein the circuit board includes a plurality of light-emitting modules, wherein each light-emitting module is disposed under the at least one pressing portion.

16. The electronic device as claimed in claim 15, wherein the plurality of retaining portions and the case are formed into a shading structure.

17. The electronic device as claimed in claim 16, wherein the main body of the elastic component forms a shading portion at least one side of the retaining portion.

18. The electronic device as claimed in claim 15, wherein the surface of the at least one pressing portion has a lucent pattern or character.

19. The electronic device as claimed in claim 11, wherein the at least one pressing portion extends an extension structure respectively.

20. The electronic device as claimed in claim 11, wherein the second end of the fixing component has a fixing hole, the case has a fixing rib, wherein the fixing hole and the fixing rib are fit to each other, to fix the knob structure to the case.

21. The electronic device as claimed in claim 11, wherein the main body of the elastic component has at least one position-limiting hole, and the case has at least one position-limiting rib, wherein the position-limiting hole and the position-limiting rib are fit to each other, to have the knob structure to be positioned on the case.

22. The electronic device as claimed in claim 11, wherein the first end of at least one fixing component is connected with the outmost one of the aligned plurality of pressing portions.

* * * * *